US006153026A

United States Patent [19]

Michotte

[11] Patent Number: 6,153,026

[45] Date of Patent: Nov. 28, 2000

[54] METHOD AND DEVICE FOR TEMPER-HARDENING FLAT METAL PRODUCTS

[76] Inventor: Jacques B. Michotte, avenue Duc Godefroid Premier 18, B-1300 Wavre, Belgium

[21] Appl. No.: 09/215,000

[22] PCT Filed: Jul. 1, 1997

[86] PCT No.: PCT/DE97/00074

§ 371 Date: Jan. 11, 1999

§ 102(e) Date: Jan. 11, 1999

[87] PCT Pub. No.: WO98/02592

PCT Pub. Date: Jan. 22, 1998

[30] Foreign Application Priority Data

Jul. 11, 1996 [BE] Belgium ..... 9600634

[51] Int. Cl.[7] ..... C21D 1/54

[52] U.S. Cl. ..... 148/508; 148/645; 148/646; 266/259

[58] Field of Search ..... 266/90, 249, 259; 148/645, 646, 508

[56] References Cited

U.S. PATENT DOCUMENTS

| | | | |
|---|---|---|---|
| 541,422 | 6/1895 | Carpenter | 148/646 |
| 3,423,254 | 1/1969 | Safford et al. | 266/259 |
| 3,534,947 | 10/1970 | Lenz | 266/259 |
| 4,371,149 | 2/1983 | Takeuchi et al. | 266/90 |
| 5,885,522 | 3/1999 | Giannini et al. | 148/646 |

*Primary Examiner*—Scott Kastler
*Attorney, Agent, or Firm*—Pillsbury Madison & Sutro LLP

[57] ABSTRACT

The invention discloses a method for temper hardening flat metal products, comprising the following steps:

introducing a flat product coming out of the furnace into a temper-hardening bay, depositing this flat product on supporting elements forming a lower substantially horizontal supporting table, causing a sudden cooling of the flat product in the deposited position, by spraying a temper-hardening liquid simultaneously on the whole of its upper surface and on the whole of its lower surface, removing the flat product from the temper-hardening bay, and further, before the sudden cooling, transferring retaining elements forming together a substantially horizontal retaining table to a horizontal retaining plane at a predetermined distance above the upper surface of the flat product and, during the sudden cooling, optionally retaining the flat product on the upper retaining table, within the limits imposed by the said horizontal plane. The invention also discloses a device for implementing this method.

18 Claims, 4 Drawing Sheets

METHOD AND DEVICE FOR TEMPER-HARDENING FLAT METAL PRODUCTS

This application is the national phase of international application PCT/BE97/00074 filed Jul. 1, 1997 which designated the U.S.

The present invention relates to a process for tempering flat metallic products comprising

- an introduction of a flat product exiting from a furnace into a tempering station with an upper surface orientated upwardly and a lower surface orientated downwardly,
- a location of the flat product on support elements forming together a substantially horizontal lower support table of the tempering station,
- a sudden cooling of the flat product in the located position, by spraying a tempering liquid simultaneously on all its upper and lower surfaces, and
- a removal of the cooled flat product from the tempering station, and to a tempering apparatus for the implementation of such a process.

Tempering processes of this type, intended to temper flat metallic products, such as sheets, strips and similar products, have been known for a long time. They are batch processes in which an upper pressing table is lowered on the flat product to be tempered and is either pressed or placed down on it. The apparatuses implementing this type of process are called tempering presses.

These processes enable the simultaneous spraying of the whole upper and lower surfaces of the flat product exiting out of the furnace with a tempering liquid, for example water. However, they have the major drawback of producing scratches on the surface of the tempered sheets. In effect, at the time of tempering, the sheets are subjected to a sudden shrinkage whilst they are gripped between support elements of the upper and lower tables in the shape of fingers. Another drawback is the fact that at the time of tempering, the forward portion of the sheet exhibits a difference in temperature relative to the rear portion which has just exited from the furnace. The stresses caused by tempering are not therefore uniform over the whole surface of the tempered sheets.

Continuous tempering processes are also known in which the sheets are tempered progressively as they exit from the furnace. Each portion of the sheet is therefore always cooled under the same conditions. However, such a sheet exhibits with this process enormous differences in temperature between a portion already tempered and one which has exited from the furnace but is not yet tempered. These differences lead to stresses and deformations in the sheets, to such an extent that this type of process has been virtually abandoned, especially for large sheets (see on this subject patents FR-1415912, U.S. Pat. No. 3,423,254, U.S. Pat. No 3,420,083, NL-135696, BE-A-758799, BE-A-789130 and U.S. Pat. No. 4,149,703).

The object of the present invention is to provide a batch tempering process and apparatus which does not appreciably exhibit the major drawbacks described above. In particular it has for its object to allow tempering or hyper-tempering of fine flat products, for example stainless steel sheets with a thickness of 3 to 30 mm, or carbon steel sheets with a thickness of 3 to 10 mm, to produce flat sheets which are substantially without scratches.

To solve this problem according to the invention, a process is provided similar to the one described above which comprises, before the sudden cooling, a transference of retaining elements, which form together a substantially horizontal upper holding table, into a horizontal retaining plane located a predetermined distance above the upper surface of the flat product, and during sudden cooling a possible retention of the flat product by the upper retaining table in the limits imposed by the said horizontal retaining plane. This process, therefore, is no longer tempering under compression and thus no longer has the drawbacks of the latter. On the contrary, the advantages of a simultaneous and uniform spraying on the whole of the upper surface and the whole of the lower surface of the sheet to be cooled are retained.

Advantageously, the above mentioned retaining plane is located at a distance of the order of 0.5 to 2.5 mm from the upper surface of the flat product to be tempered, preferably of the order of 0.8 to 1.2 mm, in particular of 1 mm.

In one embodiment of the invention the transference comprises a comprises a continuous measurement of the position of the retaining table in relation to a fixed reference and a stoppage of the transference when the said measurement reaches a predetermined value, in which the retaining table is located at the said predetermined distance. It is thus possible to allow the tempering of sheets with different thicknesses, varying correspondingly the said predetermined value in relation to the thickness of the sheet to be tempered.

In an advantageous embodiment of the invention, the transference comprises a continuous measurement of the position of the retaining table, in several places, in relation to a fixed reference, a taking of the mean of these measurements, a calculation of the divergence between each one of these measurements and the mean, a differential control of the transference of each of said places according to the calculated corresponding divergence, and a stoppage of the transference when the said mean reaches a predetermined value, in which the retaining table is located at the said predetermined distance. It is thus possible to ensure in a completely perfect manner the horizontal orientation of the upper table and a completely reliable retaining plane.

In a perfected embodiment of the invention, the tempering liquid is provided from sources of tempering liquid arranged above and beneath the flat product to be cooled and in that the process comprises a relative displacement between sources of the tempering liquid and the flat product to be cooled. Thus it becomes possible to eliminate the cooling heterogeneities from one portion of the sheet to another, resulting from the fact that the sources of tempering liquid and the sheet are fixed one in relation to the other. Advantageously, the sheet is subjected to a horizontal displacement, in particular following a to-and-fro movement.

Other embodiments of the invention are indicated in the detailed description which follows.

The invention also relates to a tempering apparatus for flat metallic products comprising

- means for introducing a flat product exiting from a furnace into the apparatus with an upper surface directed upwardly and a lower surface directed downwardly,
- support elements forming a lower support table on which the introduced flat product is placed in a substantially horizontal position,
- means for sudden cooling of the flat product in the located position which submit it to a spray of tempering liquid simultaneously over all of its upper surface and all of its lower surface, and
- means for removal of the cooled flat product from the tempering apparatus.

According to the invention, the apparatus comprises retaining elements forming together a substantially horizontal upper holding table, transference means capable of conveying the retaining elements above the upper surface of the flat product, and control means for the transference means capable of controlling the transference means and of stopping them when the retaining elements are in a horizontal retaining plane located a predetermined distance above the upper surface of the flat product to be tempered.

Other details and distinctive features of the invention will be described in the following description, as a non-limiting example and with reference to the accompanying drawings.

In the various drawings, identical or equivalent elements are designated with the same references.

Figure 1:
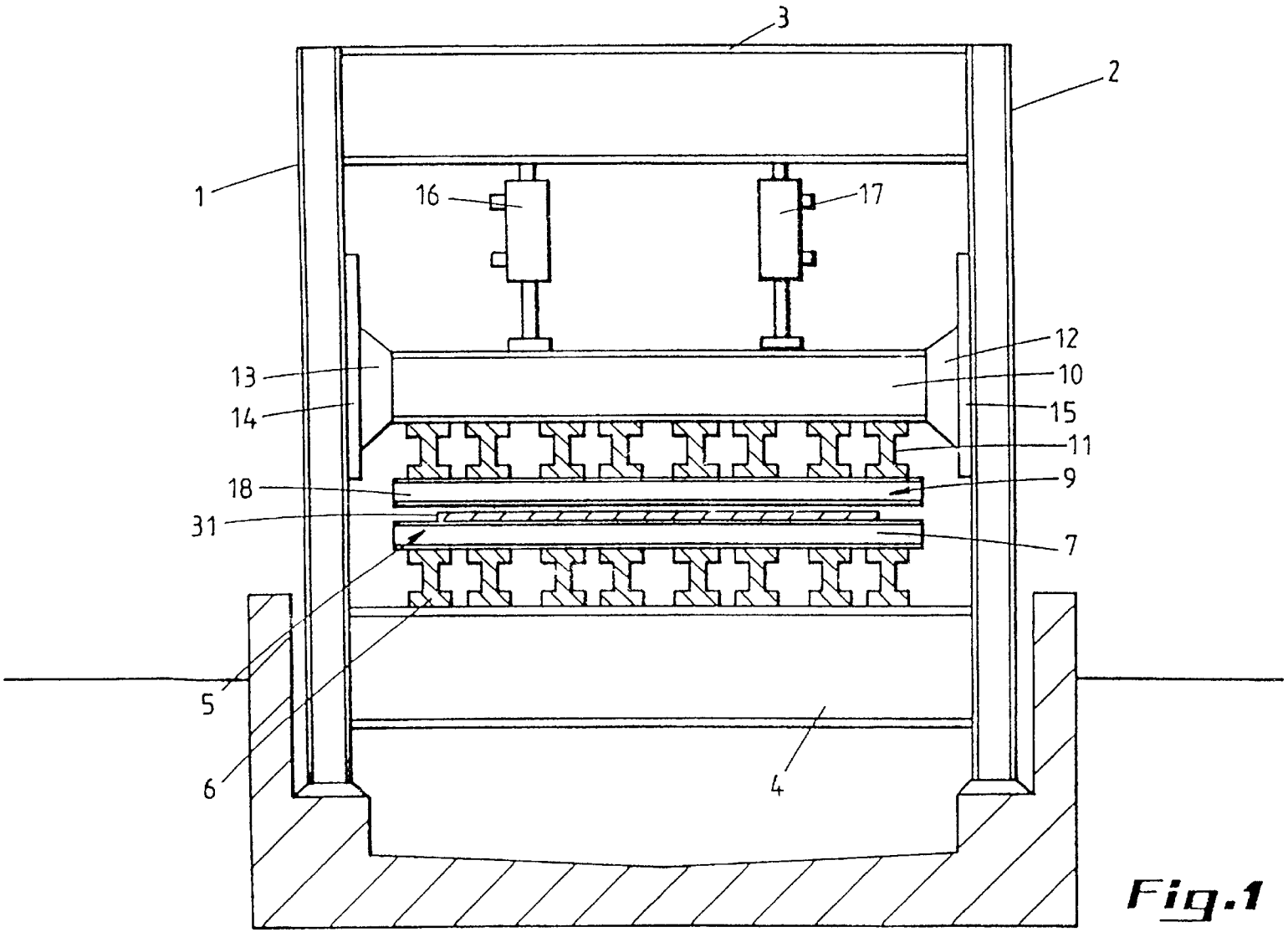
FIG. 1 shows a diagrammatic front view of a tempering apparatus according to the invention.
Figure 2:
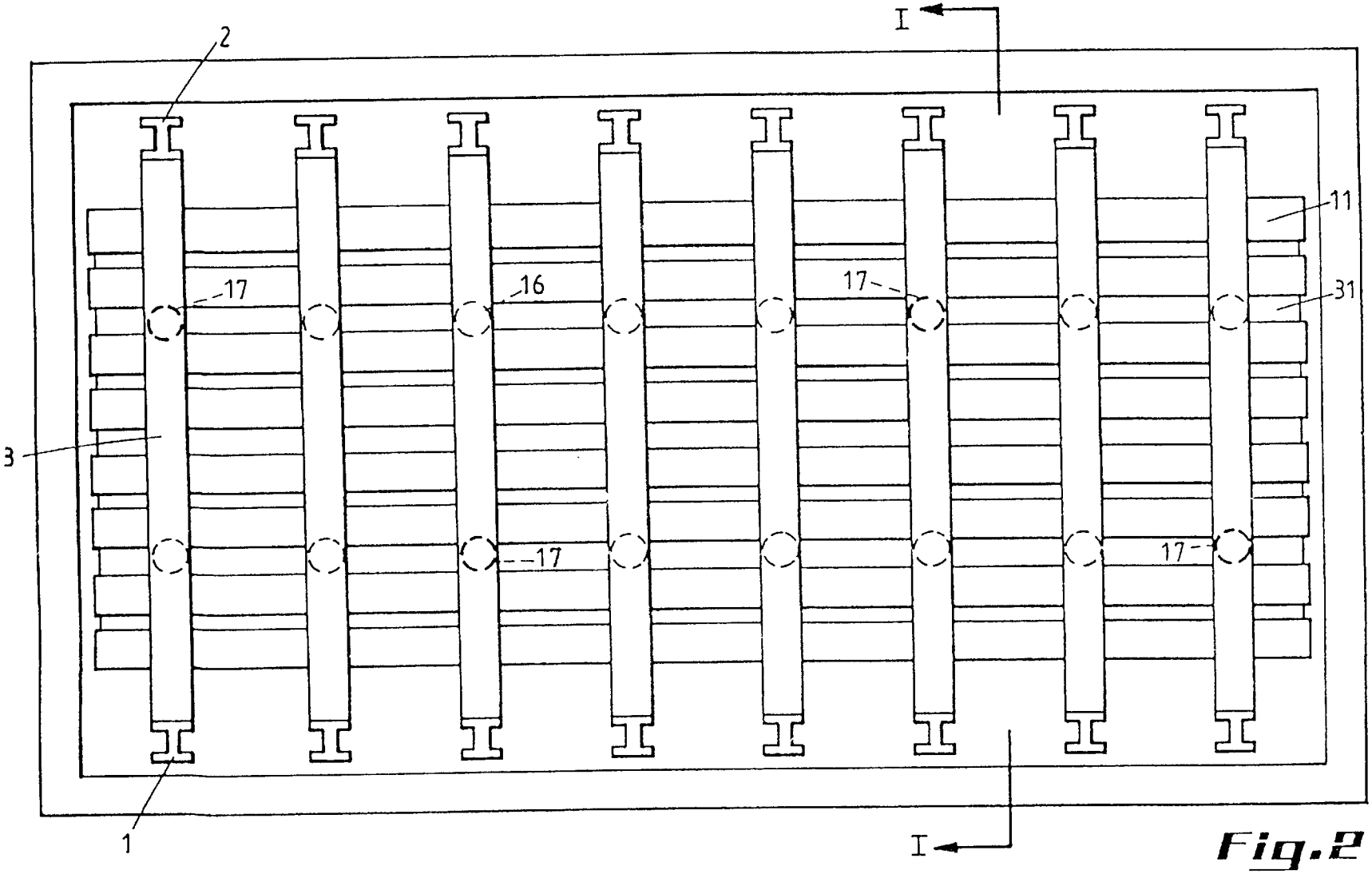
FIG. 2 shows a diagrammatic plan view of the apparatus shown in FIG. 1.
Figure 4:
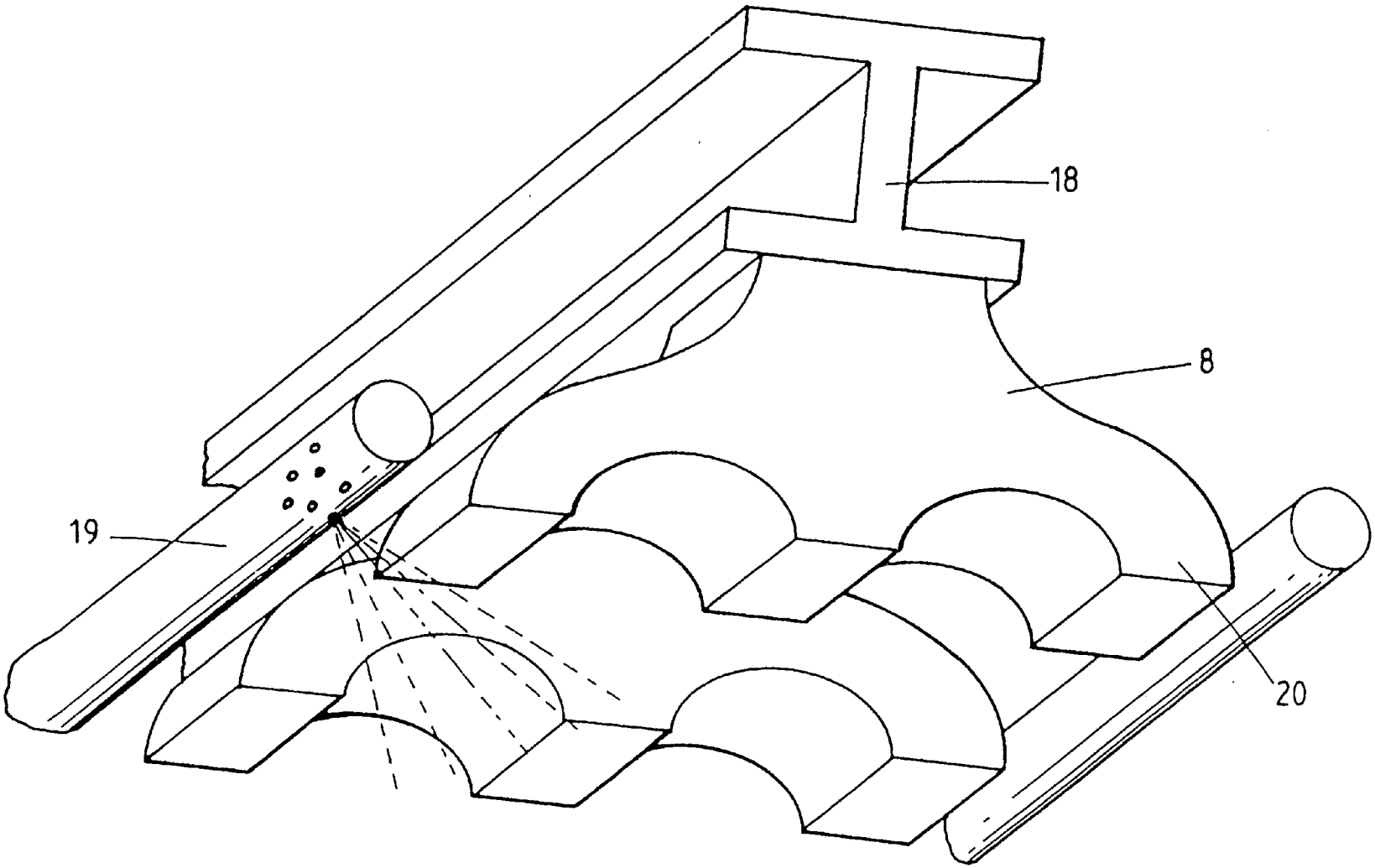
FIG. 4 shows a detail of an upper table of the apparatus shown in FIG. 1.

As illustrated by the embodiments shown in FIGS. 1 and 2, the apparatus comprises a series of gantries made of two columns 1 and 2 and two fixed crosspieces 3 and 4. The lower fixed crosspieces 4 support through longitudinal girders 6, a lower table 5 which in the illustrated example is fixed. This table 5 is formed by parallel beams 7 spaced from one another. These beams themselves support, in a manner not shown, known support elements, for example in the shape of claws. The latter can, for example, take the shape of the retaining elements shown in FIG. 4, in an inverted position.

On the upper side, an upper table 9, similar to the lower table is attached to movable beams 10 via longitudinal girders 11. The movable beams 10 are fitted with end blocks 12 and 13 able to slide on guides 14 and 15 fitted on columns 1 and 2. In the case illustrated, each one of the movable beams 10 is supported by two hydraulic rams 16 and 17.

In a similar way to lower table 5, the upper table 9 is made of parallel spaced beams 18. Retaining elements are suspended, according to the invention, from these beams and in this example can be holding claws 8 such as those shown in FIG. 4.

The means of introducing the sheet 31 to be tempered is a known technique and is therefore not shown. There is provided between the exit from the reheating furnace and the entrance to the tempering apparatus parallel rollers turning on their axis in order to drive the sheet horizontally, that is to say with an upper surface orientated upwardly and an lower surface orientated downwardly (see for example FR-14115912). Inside the tempering apparatus, identical rollers are mounted on a framework which can be, in a known manner, lifted and lowered. During the entry of the sheet, the framework is lifted and the rollers move the sheet. When the sheet is completely inside the apparatus, the framework is lowered and the rollers are retracted between the beams 7 of the lower table. Such an arrangement is provided in the known tempering presses, notably in those marketed by Messrs DREVER CY. It has therefore not been shown in detail in the drawings. Similarly, the means for removal of a cooled flat product from the tempering apparatus are similar rollers, known to specialists, and which are therefore not shown or described in greater detail here. The sudden cooling means of the flat product to be tempered are, in the example illustrated in FIG. 4, perforated pipes 19 fed with pressurized tempering liquid, notably water. Such pipes, known to specialists, are laid out above and under the sheet to be cooled in order to be able to spray its upper and lower surfaces in a manner as uniform as possible. The supply means for these pipes are not shown as they are widely known to specialists.

Figure 3:
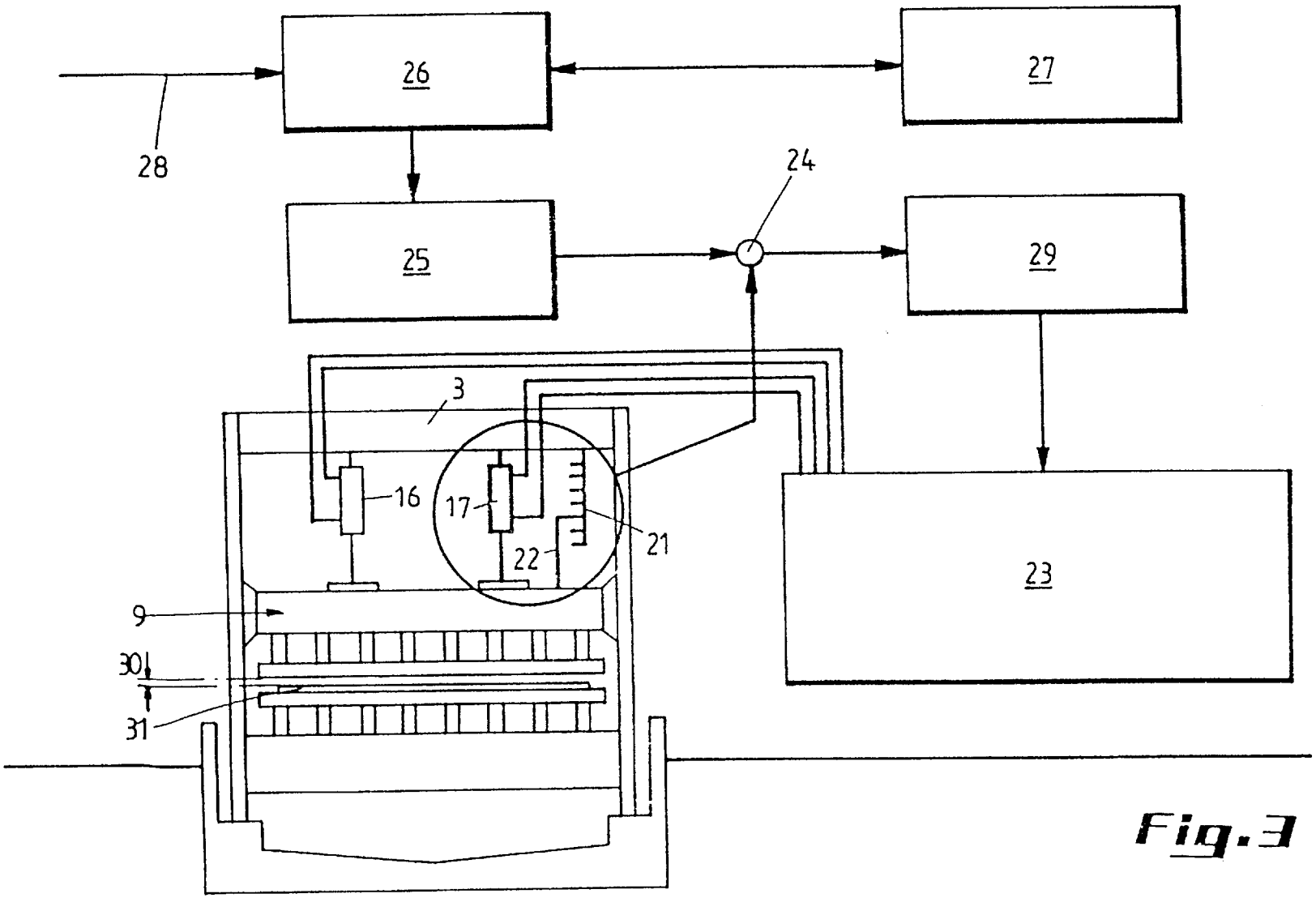
FIG. 3 shows a block diagram of a control unit for apparatus according to the invention.

The tempering apparatus according to the invention comprises a transfer means for the upper table 9, which in the illustrated case, are hydraulic rams 16 and 17. It should be noted that a table, such at that illustrated, weighs approximately fifty tonnes. As it is mainly made of longitudinal and transverse beams, it does not have a very great rigidity. Consequently, it is necessary to guide the rams precisely to convey the end of the fingers 20 of the retaining claws 8 into a horizontal plane located at a predetermined distance from the sheet to be tempered. Ram 17 of FIG. 1 is a "master" ram which is fitted with an integrated or external position coder which allows continuous measurement of the position of the table at any position in relation to a fixed reference. In FIG. 3, can be seen such a position coder consisting of a measuring scale 21 mounted on a fixed crosspiece 3 and a measurement reader 22 mounted on a lower table 9, at the foot of master ram 17. Ram 16 in FIG. 1 is guided simultaneously with ram 17, but is a slave to the movement, that is to say to the output produced by the introduced pressurizing fluid.

In FIG. 2, one can see in this embodiment four master rams 17 located alternatively on the left and on the right of the tempering apparatus in order to ensure the accuracy of the upper table along all of its length. Thus, as illustrated in FIG. 3, the tempering apparatus comprises a hydraulic unit 23 intended to feed the rams with pressurized medium, this unit also controls the support framework of the sheet carrying rollers and allows its ascent and descent.

Hydraulic unit 23 comprises, for example, proportional valves, stop valves and flow dividers. These valves and dividers are in a number corresponding to the number of gantries of the device. The flow dividers ensure a distribution of the flow of pressurized medium between the left and right rams of the same gantry. The proportional valve regulates the output produced by the ram as a function of the position indicated by the position coder linked to the master ram 17. The stop valves arrest the upper table when it attains the required position.

The hydraulic unit 23 is controlled by control means. These control means comprise the position coder 21, 22 which continuously transmits its readings to a comparator 24. This comparator receives from a programmable means 25 a predetermined set-point value and compares it with the measurements received from the position coder. The divergences calculated by comparator 24 is transmitted to a position regulator 29 which may comprise control cards, with one card for each gantry controlling a master ram 17. According to the signals received, as described below in greater detail, the card controls the proportional valves and the stop valves of the hydraulic unit 23. The programmable means receives information and instructions from a computer monitoring system 26, itself connected to a works management computer system 27.

The operation of the tempering apparatus according to the invention will now be described.

Flat products to be tempered, especially sheet metal, exit continuously from a reheating furnace onto a roller table and are immediately introduced on to the rollers supported by the framework of a tempering apparatus. When the sheet is completely inside the latter, the framework is lowered and the rollers are retracted between beams 7 of the lower table of the tempering apparatus.

The sheet is thus located on the support elements, which in this case can for example be known support claws, provided with upwardly directed fingers.

During the introduction and the positioning of the sheet, the pistons of the rams 16 and 17 are in their retracted positions and the upper table 9 is in its high position.

It is afterwards lowered in a controlled matter until retaining elements 8 in the shape, for example, of retaining claws provided with downwardly directed fingers 20 are located on a retaining horizontal plane situated at a very small predetermined distance from the upper surface of the sheet (see FIGS. 1 and 3).

The computer monitoring system 26 is informed about the sheets which will be tempered according to the encoding of their identification on a terminal not shown which is, at 28, connected to system 26. System 26 then interrogates the works computer system 27 to ascertain the characteristics of this product, namely, in particular the thickness of the sheet to be tempered. On the basis of this information, system 26 transmits the thickness and the optimal tolerance (distance 30 between the sheet and the retaining elements 8 in the lowered position of table 9) to programmable means 25 which manages the whole of the tempering process sequences. These sequences are especially those which relate to the ascent and the descent of the framework carrying the rollers, the entry and exit movements of the sheet in and out of the apparatus and the movement of the upper table.

For this last mentioned movement, programmable means 25 transmits to comparator 24 a predetermined set-point value in which the retaining elements 8 are at the said predetermined optimal distance 30. Comparator 24 compares this value with the mean of the values continuously transmitted by the position coders associated with master rams 17. It also compares each measurement received from the position coders with this mean and thus determines different divergences. The divergences are then transmitted to regulator 29 which correspondingly commands the valves of the hydraulic unit 23. As a control card is allotted to each master ram 17, it is possible to regulate the movement of upper table 9 towards the lower position in different ways here and there by spot control in order to obtain a perfectly plane and horizontal position of table 9 at the lowest point. In this position, comparator 24 compares the said mean of the measurements with the set-point value, notes that there is no longer a divergence and transmits a stop signal to the regulator.

Preferably, the distance 30 will be of the order of mm or less. In this way, the retaining elements 8 do not touch the upper surface of the sheet.

One then proceeds with the tempering or hyper-tempering of the sheet. Programmable means 25 control the feed of the tempering liquid under pressure to pipes 19 which spread it as uniformly as possible on the upper and lower surfaces of the sheet.

During this sudden cooling, the sheet can thus shrink without being gripped between the upper and the lower tables. The stress problems which result in the sheet and the appearance of scratches on the surface largely disappear. If, during this shrinkage, a sheet becomes slightly deformed, the distance 30 is calculated to retain this product within the limits of the horizontal holding plane formed by fingers 20 of the retaining elements 8 within limits which are acceptable in the process. Thus one avoids the cooling heterogeneities, which without this holding plane will result in the formation of channels for the tempering liquid caused by the deformation of the sheet.

After tempering the roller table is lifted and the sheet exits from the tempering apparatus.

One thus obtains sheets which have not been subjected to practically any stress during the cooling process. Contrary to what was the general opinion according to the previous methods, the treated sheets according to the invention are not subjected to temper rolling during cooling and, on the contrary, the sheets are "liberated" to avoid the formation of internal stresses during tempering. As tempering is, according to the invention, carried out in the most uniform manner possible, there is practically no stress in the sheet, and this without pressing, and there are no longer any scratches, at least on the upper surface of the sheets.

The scratches that occasionally form on the lower surface are reduced to a minimum because, especially in the case of thin sheets, the contact pressure between the retaining elements and the sheet is very small and corresponds only to the weight of the sheet.

It should be understood that this invention is in no way limited to the embodiment described above and that many modifications can be made without falling outside the scope of the attached claims.

One can, for example, imagine that the support elements of the lower table and the retaining elements of the upper table are not claws but rather rollers, for example like those used in the apparatus for continuous tempering (see especially U.S. Pat. No. 3,423,254). These rollers can be stopped once the sheet is entirely within the tempering apparatus. Advantageously, these rollers can be ribbed or grooved, possibly in spiral fashion (see for example U.S. Pat. No. 3,420,083 and U.S. Pat. No. 4,149,703).

One can also imagine that once the sheet is completely within the tempering apparatus, these rollers can be rotated, for example following a to-and-fro movement. This causes an oscillating movement of the sheet in relation to pipes 19 and therefore a better distribution of the tempering liquid on the sheet surfaces during the process and this without contact of the sheet with the upper table.

One can also cause a displacement of the spraying system in relation to the sheet, for instance by mounting spraying ramps on a movable oscillating framework controlled by a link/crank device. A rotation of the spraying ramps about their axes can also be provided.

One could also provide retaining and support elements in the shape of rollers or balls. The front face of the fingers of the holding elements and the support elements in the shape of claws could also be grooved or chamfered or have a hemispherical profile.

What is claimed is:

1. Tempering process for flat metal products comprising an introduction of a flat product exiting from a furnace into a tempering station with an upper surface oriented upwardly and a lower surface oriented downwardly, a location of the flat product on support elements forming together a substantially horizontal lower support table of the tempering station, a sudden cooling of the flat product in the located position by spraying a tempering liquid simultaneously on all its upper and lower surfaces, and a removal of the cooled flat product from the tempering station, as well as before the sudden cooling, a transference of retaining elements forming together a horizontal upper retaining table towards the upper surface of the flat product to be tempered, and comprising a stoppage of the transference with immobilization of the retaining elements in a horizontal retaining plane located at a distance from the upper surface of the flat product, and during the sudden cooling, a retention of the flat product by immobilized retaining elements, only when the flat product has a tendency to deform outside the limits imposed by the said horizontal retaining plane.

2. Process according to claim 1, characterized in that the said retaining plane is located at a distance of about 0.5 to 2.5 mm from the upper surface of the flat product to be tempered.

3. Process according to claim 1, wherein the transference comprises a continuous measurement of the position of the retaining table in relation to a fixed reference and there is a stoppage of the transference when the said measurement reaches a value, in which the retaining table is located at the said distance.

4. Process according to claim 1, wherein the transference comprises a continuous measurement of the position of the retaining table, in several places, in relation to a fixed reference, a taking of the mean of these measurements, a calculation of the divergence between each one of these measurements and the mean, a differential control of the transference of each of said places according to the calculated corresponding divergence and a stoppage of the transference when the said mean reaches a value, in which the retaining table is located at the said distance.

5. Process according to claim 1, wherein the tempering liquid is provided from sources of tempering liquid arranged above and beneath the flat product to be cooled and in that the process comprises a relative displacement between sources of the tempering liquid and the flat product to be cooled.

6. Process according to claim 1 wherein, during the sudden cooling, the flat product is stationary.

7. Process according to any one of the claim 1 wherein, during the sudden cooling, the flat product is subjected to a horizontal displacement following a to-and-fro movement.

8. Tempering apparatus for flat metallic products comprising means for introducing a flat product exiting from a furnace into the apparatus with an upper surface directed upwardly and a lower surface directed downwardly support elements forming a lower support table on which the introduced flat product is placed in a substantially horizontal position, retaining elements forming together a substantially horizontal upper holding table transference means capable of conveying the retaining elements above the upper surface of the flat product, means for sudden cooling (19) of the flat product in the located position which submit it to a spray of tempering liquid simultaneously over all of its upper surface and all of its lower surface, and means for removal of the cooled flat product from the tempering apparatus comprising control means for the transference means capable of controlling the transference means and of stopping them to immobilize the retaining elements in a horizontal retaining plane located a distance above the upper surface of the flat product to be tempered, and in that during the sudden cooling the immobilized retaining elements retain the product flat only when it has a tendency to deform outside limits laid down by the said horizontal retaining plane.

9. Apparatus according to claim 8, characterized wherein the control means comprises at least one measurement reader which continuously measures the position of the retaining table in relation to a fixed reference, a comparator which determines the presence or absence of a divergence between the said measurements and a predetermined value in which the retaining elements are at the said predetermined distance of the flat product to be tempered, and a position regulator acting on the transference means as a function of the divergence.

10. Apparatus according to claim 8 wherein the control means comprises a plurality of measurements readers which each continuously measures the position of a particular place on the retaining table in relation to a fixed reference, and wherein the comparator compares in addition the divergence between each measurement and their mean, and wherein the position regulator acts differently on each or some of the transference means according to the predetermined divergences in each of the particular places and stops the transference means when the comparator determines an absence of divergence between the said mean and the value.

11. Apparatus according to claim 8 wherein the transference means comprise hydraulic ram connected between a fixed framework of the apparatus and the upper retaining table and fed by a hydraulic unit according to the signals received from the control means.

12. Apparatus according to claim 8 wherein the retaining elements and the Support elements are identical elements arranged symmetrically in relation to a horizontal plane.

13. Apparatus according to claim 8 wherein the support elements and/or the retaining elements are claws, jaws, rollers with grooves or with ribs or equivalent means which, when in contact with the flat element to be tempered, only cover a partial area of the latter.

14. Apparatus according to claim 8 wherein the support elements are rollers which drive the flat element in a to-and-fro movement during the sudden cooling.

15. Apparatus according to claim 8 wherein the sudden cooling means comprises spraying pipes provided with an oscillating movement.

16. Process according to claim 2 wherein the retaining plane is located at a distance of about 0.8 to 1.2 mm from the upper surface of the flat product to be tempered.

17. Process according to claim 2 wherein the retaining plane is located at a distance of about 1 mm from the upper surface of the flat product to be tempered.

18. Apparatus according to claim 15 wherein said spraying pipes are driven in rotation about their axes.

* * * * *